US010662738B2

(12) United States Patent
Bacsik et al.

(10) Patent No.: US 10,662,738 B2
(45) Date of Patent: May 26, 2020

(54) PRESSURE INSENSITIVE COUNTING TOE SLEEVE

(71) Applicant: Weatheford Technology Holdings, LLC, Houston, TX (US)

(72) Inventors: Ryan R. Bacsik, Houston, TX (US); Jason J. Brasseaux, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 741 days.

(21) Appl. No.: 15/042,260

(22) Filed: Feb. 12, 2016

(65) Prior Publication Data

US 2016/0237785 A1 Aug. 18, 2016

Related U.S. Application Data

(60) Provisional application No. 62/115,807, filed on Feb. 13, 2015.

(51) Int. Cl.

| | |
|---|---|
| ***E21B 34/10*** | (2006.01) |
| ***E21B 34/14*** | (2006.01) |
| *E21B 34/00* | (2006.01) |

(52) U.S. Cl.

CPC ..... *E21B 34/10* (2013.01); *E21B 34/14* (2013.01); *E21B 2034/007* (2013.01)

(58) Field of Classification Search

CPC ..... E21B 34/10; E21B 34/14; E21B 2034/007
See application file for complete search history.

(56) References Cited

U.S. PATENT DOCUMENTS

| | | | | |
|---|---|---|---|---|
| 4,403,659 | A | 9/1983 | Upchurch | |
| 8,267,178 | B1 | 9/2012 | Sommers et al. | |
| 8,899,334 | B2 * | 12/2014 | Merron | E21B 34/14 166/323 |
| 9,359,865 | B2 * | 6/2016 | Mailand | E21B 23/006 |

(Continued)

FOREIGN PATENT DOCUMENTS

| | | | |
|---|---|---|---|
| EP | 2372080 | A2 | 10/2011 |
| GB | 2504699 | A | 2/2014 |

OTHER PUBLICATIONS

PCT Int'l Search Report received in copending PCT Application No. PCT/US2016/017662 dated Jun. 22, 2016, 7 pages.

(Continued)

*Primary Examiner* — Matthew R Buck
(74) *Attorney, Agent, or Firm* — Blank Rome, LLP

(57) ABSTRACT

A downhole tool has a housing with a communication path extending from a first to a second part of a bore. An indexer disposed in the communication path is movably responsive to applied pressure at the first part. The indexer counts a number of applications of the applied pressure and permits fluid communication of the applied pressure from the first part to the second part in response to the counted number. An insert in the housing bore sealably encloses the second part of the communication path and is movable from a first position covering to a second position uncovering a port in the housing. At least a portion of the insert acted upon by the applied fluid pressure in the second part initiates movement of the insert from the first to the second position. A kit having a modular housing portion and the indexer can adapt the downhole tool for use.

20 Claims, 6 Drawing Sheets

(56) References Cited

U.S. PATENT DOCUMENTS

| | | | | |
|---|---|---|---|---|
| 10,087,712 | B2 * | 10/2018 | Kennedy | E21B 34/14 |
| 2013/0299199 | A1 | 11/2013 | Naedler et al. | |
| 2014/0251619 | A1 | 9/2014 | George et al. | |
| 2014/0251620 | A1 | 9/2014 | George et al. | |
| 2014/0262323 | A1 | 9/2014 | Cox et al. | |
| 2014/0299329 | A1 * | 10/2014 | Kippola | E21B 21/103 166/373 |

OTHER PUBLICATIONS

Canadian Office Action received in copending Canadian Application No. 2,976,368 dated Jun. 19, 2018, 3 pages.
Weatherford, "ZoneSelect(R) Completions System Time Delay (TD) Toe Sleeve," Brochure, copyright 2013.
Weatherford, "ZoneSelect(R) Atmoshpheric (AC) Toe Sleeve," Brochure, copyright 2013-2014.
Weatherford, "ZoneSelect(R) Rupture Disk (RD) Toe Sleeve," Brochure, copyright 2013.
Weatherford, "ZoneSelect(R) Completions System Smart Toe Sleeve," Brochure, copyright 2014.
Weatherford, "ZoneSelect(R) Toe Sleeve," Brochure, copyright 2009.
Int'l Preliminary report on Patentability in counterpart PCT Appl. PCT/US2016/017662, dated Aug. 24, 2017, 7-pgs.
First Office Action in counterpart Canadian Appl. 2,976,368, dated Jun. 19, 2018, 3-pgs.

* cited by examiner (Background)

PRESSURE INSENSITIVE COUNTING TOE SLEEVE

CROSS-REFERENCE TO RELATED APPLICATIONS

This application claims priority to U.S. Provisional Appl. 62/115,807, filed 13 Feb. 2015, which is incorporated herein by reference in its entirety.

BACKGROUND OF THE DISCLOSURE

During hydraulic fracturing operations, operators want to minimize the number of trips they need to run in a well while still being able to optimize the placement of stimulation treatments and the use of rig/fracture equipment. Therefore, operators prefer to use a single-trip, multistage fracturing system to selectively stimulate multiple stages, intervals, or zones of a well. Typically, this type of fracturing system has a series of open hole packers along a tubing string to isolate zones in the well. Interspersed between these packers, the system has fracture sleeves along the tubing string. These sleeves are initially closed, but they can be opened to stimulate the various intervals in the well.

As shown in FIG. 1, for example, a tubing string 12 for a wellbore fluid treatment system 20 deploys in a wellbore 10 from a rig 30 having a pumping system 35. The tubing string 12 has sliding sleeves 50 disposed along its length. Various packers 40 isolate portions of the wellbore 10 into isolated zones. In general, the wellbore 10 can be an opened or cased hole, and the packers 40 can be any suitable type of packer intended to isolate portions of the wellbore into isolated zones.

The sliding sleeves 50 deployed on the tubing string 12 between the packers 40 can be used to divert treatment fluid selectively to the isolated zones of the surrounding formation. The tubing string 12 can be part of a fracture assembly, for example, having a top liner packer (not shown), a wellbore isolation valve (not shown), and other packers and sleeves (not shown) in addition to those shown. If the wellbore 10 has casing, then the wellbore 10 can have casing perforations 14 at various points.

As conventionally done, operators deploy a setting ball to close the wellbore isolation valve (not shown) and positively seal off the tubing string 12. Operators then sequentially set the packers 40. Once all the packers 40 are set, the wellbore isolation valve acts as a positive barrier to formation pressure.

At this point, operators rig up the fracturing surface equipment 35 and pump fluid down the wellbore to open a toe sleeve 60 toward the end of the tubing string 12. This treats a first zone of the formation. Then, in later stages of the operation, operators selectively actuate the sliding sleeves 50 between the packers 40 to treat the isolated zones depicted in FIG. 1. In the most common approach, operators actuate the sliding sleeves 50 by dropping successively increasing sized balls down the tubing string 12. Each ball opens a corresponding sleeve 50 so fracture treatment can be accurately applied in each zone up the tubing string 12.

Several types of toe sleeves 60 have been used on tubing strings. In FIG. 2A, for example, a conventional toe sleeve 60, such as Weatherford's ZoneSelect toe sleeve, is a differential opening sleeve normally placed at the bottom or "toe" of the tubing string 12. The toe sleeve 60 is activated when a ball lands on a landing seat 73 on the sleeve's insert 70 and tubing pressure is applied against the seated ball to shear the sleeve's insert 70 free. The sleeve's insert 70 shifts in the housing 62, decreasing the enclosed volume 72. Once this occurs, the sleeve's insert 70 opens past ports 66 in the sleeve's housing 62 and locks in place so flow can be diverted to the wellbore through the open toe sleeve 60 from the housing's bore 64 and out the ports 66.

In FIG. 2B, another type of toe sleeve has a time delay, such as Weatherford's ZoneSelect Time Delay (TD) toe sleeve 60 used in a multizone completion system. Typically placed at the toe of a cemented completion, applied pressure ruptures a disc 68 in this TD toe sleeve 60, which exposes a piston 75 to differential pressure within the toe sleeve 60. The piston 75 moves slowly across concentric inner and outer ports 66*a-b* as the fluid being acted on is metered while passing from a primary chamber to a secondary atmospheric chamber.

The time-delay toe sleeve 60 is run in-hole as part of the tubing string 12. When the optimum setting depth is reached, tubing pressure is applied to check casing integrity and to rupture the disc 68 in the time-delay toe sleeve 60. In this way, the time-delay mechanism (i.e., piston 75, chambers, etc.) meters the toe sleeve's opening and eventually creates a pathway to begin stimulation operations. Depending on the application, the primary stimulation may be performed through the time-delay toe sleeve 60.

The time-delay toe sleeve 60 actuates at or below the casing test pressure, enabling the test pressure to be the highest pressure the system will be exposed to throughout operations. The time-delay toe sleeve 60 can avoid the inherent risk of a standard, hydraulically actuated toe sleeve 60 of FIG. 2A, which may open below a preset value (before pressure test is complete) or may require excessive pressure to open (exceeding casing and surface equipment limitations).

In FIG. 2C, another type of toe sleeve uses an atmospheric chamber to control opening, such as the Weatherford atmospheric chamber (AC) toe sleeve 60 used in a multistage completion system. The AC toe sleeve 60 is typically placed at the toe of the tubing string 12, and the AC toe sleeve 60 is actuated by applied tubing pressure creating enough hydraulic force on the sleeve's insert 70 to shear the insert 70 free of shear pins 76. The insert 70 within the AC toe sleeve 60 then slides past ports 66 in the sleeve's housing 62 and locks open. Preferably, the insert 70 opens upward to prevent a liner wiper dart from inadvertently forcing the sleeve 60 open during earlier operations.

The AC toe sleeve 60 is also run in the wellbore 10 as part of the tubing string 12. When the optimum setting depth is reached, tubing pressure is applied to actuate the openhole packers 40 and test the casing. Additional pressure is then applied to open the AC toe sleeve 60 and initiate communications to the formation for subsequent stimulation operations from the housing's bore 64 and out the ports 66.

In FIG. 2D, yet another type of toe sleeve uses a rupture disc to control operations, such as the Weatherford ZoneSelect Rupture Disc (RD) toe sleeve 60 shown used in a multizone completion. Placed at the toe of the tubing string 12, the RD toe sleeve 60 actuates when applied tubing pressure causes a disc 68 to rupture in the sleeve 60. The insert 70 inside the sleeve 60 then slides past ports 66 in the sleeve's housing 62 and locks in place. After the RD toe sleeve 60 is open, balls or composite plugs can be pumped down to begin stimulation operations. If required, the first stimulation operation can be performed through the open RD toe sleeve 60 from the housing's bore 64 and out the ports 66.

Another toe sleeve, such as the SMART toe sleeve 60 in FIG. 2E, allows the casing string to be tested to its full working pressure with an unlimited hold period and without exceeding the working pressure. Placed at the bottom or toe of the tubing string 12, the SMART toe sleeve 60, which is available from Weatherford, actuates and opens after two internal pressure applications. Once the SMART toe sleeve 60 is open, balls or composite plugs can be pumped downhole for subsequent stimulation.

The sleeve 60 includes a housing 62 with an insert 70 movable in its bore 64. The sleeve 60 has two shear features, including initiation shear screws 80 and arming shear screws 82. The initiation shear screws 80 are set for wellbore conditions, and the arming shear screws 82 have a predetermined value. Multiple low pressure tests can be applied to the closed sleeve 60 as long as the initiation valve for the initiation shear screws 80 is not exceeded. The first working pressure test shears the initiation shear screws 80, allowing the insert 70 to stroke and compress a wave spring 75. A snap ring 84 is partially collapsed during this stroke. After the first test, pressure is vented, and the load from the wave spring 75 shears the activation shear screws 82, which arms the sleeve 60 for the next pressure cycle. When working pressure is then applied, the insert 70 again strokes, which fully collapses the snap ring 84 so that it is no longer active. When the pressure is vented, the spring 75 then fully moves the insert 70 so that the ports 66*a-b* align allowing fluid communication out of the housing's bore 64 to the wellbore.

The SMART sleeve 60 can be used in horizontal and vertical wells, and in cemented and openhole completions. Because the SMART sleeve 60 does not open after the first pressure application, operators can maintain well integrity if issues arise at the surface. Each application of pressure can be held for an indefinite amount of time, enabling two opportunities to satisfy any regulatory requirements. The SMART sleeve 60 locks open, which prevents accidental tool closure caused by intervention tools.

Some implementations require that a tubing pressure test be performed for a specified period of time before wellbore fluid is introduced into the formation. As can be seen from the discussion above, some of the current toe sleeves 60 either open instantly or use a time delay by forcing hydraulic fluid through a restrictor device to slow the opening of the sleeve 60. Historically, oil wells have simply tested their tubing at a lower pressure than the pressure actually required to open the toe sleeve 60. Unfortunately, new leak paths can be created by increasing the tubing pressure to open the toe sleeve 60 above the test value used in the tubing pressure test. For this reason, more recent methods for opening toe sleeves attempt to delay the opening of the toe sleeve to allow a higher pressure tubing test to be performed before actually opening the toe sleeve. This overcomes the problems associated with over-pressurizing the tubing in order to open the toe sleeve.

Even though such systems have been effective, operators are continually striving for new and useful ways to open a toe sleeve downhole for fracture operations or the like. The subject matter of the present disclosure is directed to overcoming, or at least reducing the effects of, one or more of the problems set forth above.

SUMMARY OF THE DISCLOSURE

According to the present disclosure, a downhole tool is actuatable in response to applied pressure. The tool has a housing, an insert, and an indexer. The housing defines a housing bore therethrough and defines at least one port communicating the housing bore outside the housing. The housing has a communication path extending from a first part of the housing bore to a second part of the housing bore. The insert is movably disposed in the housing bore and sealably encloses the second part of the communication path. The insert is movable from a first position covering the at least one port to a second position uncovering the at least one port.

The indexer is disposed in the communication path and is movably responsive to the applied pressure at the first part of the communication path. The indexer counts a number of applications of the applied pressure and permits fluid communication of the applied pressure from the first part to the second part in response to the counted number. At least a portion of the insert acted upon by the applied fluid pressure in the second part initiates movement of the insert from the first position to the second position.

The indexer can include a piston having first and second piston portions. The first piston portion is movably responsive to the applied pressure at the first part and moves the second piston portion relative to sealed engagement with the second part. The first piston portion includes a ring movably disposed in a first internal space of the first part. The second piston portion includes at least one rod connected to the ring and movable therewith. The at least one rod in a first condition prevents communication of the applied pressure from the first internal space to the second part of the communication path and in a second condition permits the communication of the applied pressure from the first internal space to the second part.

A spring can be disposed in the first internal space and can bias the ring against the application of the applied pressure. Also, a pin and slot arrangement can alternatingly move the ring in the first internal space in response to each of the applications of the applied pressure. In one arrangement, the pin and slot arrangement includes a sleeve and a pin. The sleeve defines a slot profile and is rotatably disposed in the first internal space. The pin is disposed on the ring and is movable in the slot profile.

The pin and slot arrangement moves the second piston portion of the indexer relative to the sealed engagement with the second part. The second piston portion in a first condition prevents communication of the applied pressure from the first internal space to the second part, and the second piston portion in a second condition permits the communication of the applied pressure from the first internal space to the second part.

The insert can include at least one retainer at least temporarily holding the insert in the first position and being breakable in response to a level of the applied pressure acting against the portion of the insert. The insert can include a lock engageable with the housing bore when the insert is in the second position. Finally, the insert can include first and second seals sealing against the housing bore on both sides of the at least one port when the insert is in the first position.

The housing can include a barrier disposed between the housing bore and the first part of the communication path and being breachable in response to a level of the applied pressure in the housing bore. The housing can include at least one seal disposed in the second part of the communication path and engaging the portion of the insert. Finally, the housing can include a sealed chamber defined between the housing bore and the insert and decreasing in volume with movement of the insert from the first position to the second position.

The second part of the communication path in the housing can be exposed to the housing bore. In this case, the insert sealably encloses the second part of the communication path.

According to the present disclosure, the housing can have first, second, and third housing portions coupling together in series. The second housing portion couples with an end of the first housing portion and defines the second part of the communication path. The third housing portion couples with an end of the second housing portion and encloses the first part of the communication path. The insert is disposed in the first housing portion, and the portion of the insert in the first position at least partially encloses the second part of the communication path defined by the second housing portion coupled with the end of the first housing portion. In another arrangement, the first and third housing portions can couple together without the second housing portion and the indexer.

According to the present disclosure, a downhole tool is actuatable in response to applied pressure. The tool includes a housing, a piston, and an insert. The housing defines a housing bore therethrough and defines at least one port communicating the housing bore outside the housing. The housing has a communication path that communicates the housing bore with a first internal space and further communicates the first internal space with a second internal space. The piston has a first piston portion movably disposed in the first internal space and has a second piston portion movably disposed relative to sealed engagement with the second internal space. The insert is movably disposed in the housing bore and sealably encloses the second internal space of the housing. The insert is movable from a first position covering the at least one port to a second position uncovering the at least one port.

The first piston portion is movably responsive to the applied pressure from the communication path and moves the second piston portion relative to the sealed engagement with the second internal space. The first piston portion counts a number of applications of the applied pressure and permits fluid communication of the applied pressure from the first internal space to the second internal space in response to the counted number. At least a portion of the insert acted upon by the applied fluid pressure in the second internal space initiates movement of the insert from the first position to the second position.

A kit can be used for converting a downhole tool actuatable in response to applied pressure. The downhole tool has a housing with a first housing portion coupleable to a second housing portion. The housing defines a housing bore therethrough and defines at least one port communicating the housing bore outside the housing. The downhole tool has an insert movably disposed in the housing bore, and the insert is movable from a first position covering the at least one port to a second position uncovering the at least one port.

The kit includes a modular housing portion and an indexer. The modular housing portion is coupleable between the first and second housing portions and is configurable to enclose a first internal space with the first housing portion and to at least partially enclose a second internal space with the second housing portion. The modular housing portion has a communication path extending from the first internal space to the second hosing portion.

The indexer is positionable in this communication path and is movably responsive to the applied pressure at the first internal space. So arranged, the indexer is configurable to count a number of applications of the applied pressure and to permit, in response to the counted number, fluid communication of the applied pressure from the first internal space to the second internal space for initiating movement of the insert from the first position to the second position.

The indexer for the kit can be similar to that disclosed previously. In one arrangement, the indexer includes a piston having first and second piston portions. The first piston portion is movably responsive to the applied pressure at the first internal space and is configured to move the second piston portion relative to sealed engagement with the second internal space. The first piston portion can include a ring movably positionable in the first internal space, while the second piston portion can include at least one rod connected to the ring and movable therewith. The at least one rod is configurable in a first condition to prevent communication of the applied pressure from the first internal space to the second internal space and configurable in a second condition to permit the communication of the applied pressure from the first internal space to the second internal space.

A spring can be positionable in the first internal space and can be configured to bias the ring against the application of the applied pressure. Also, a pin and slot arrangement can be configured to alternatingly move the ring in the first internal space in response to each of the applications of the applied pressure. This pin and slot arrangement can includes a sleeve defining a slot profile and rotatably positionable in the first internal space and can include a pin disposed on the ring and movable in the slot profile.

The foregoing summary is not intended to summarize each potential embodiment or every aspect of the present disclosure.

DETAILED DESCRIPTION OF THE DISCLOSURE

Figure 1:
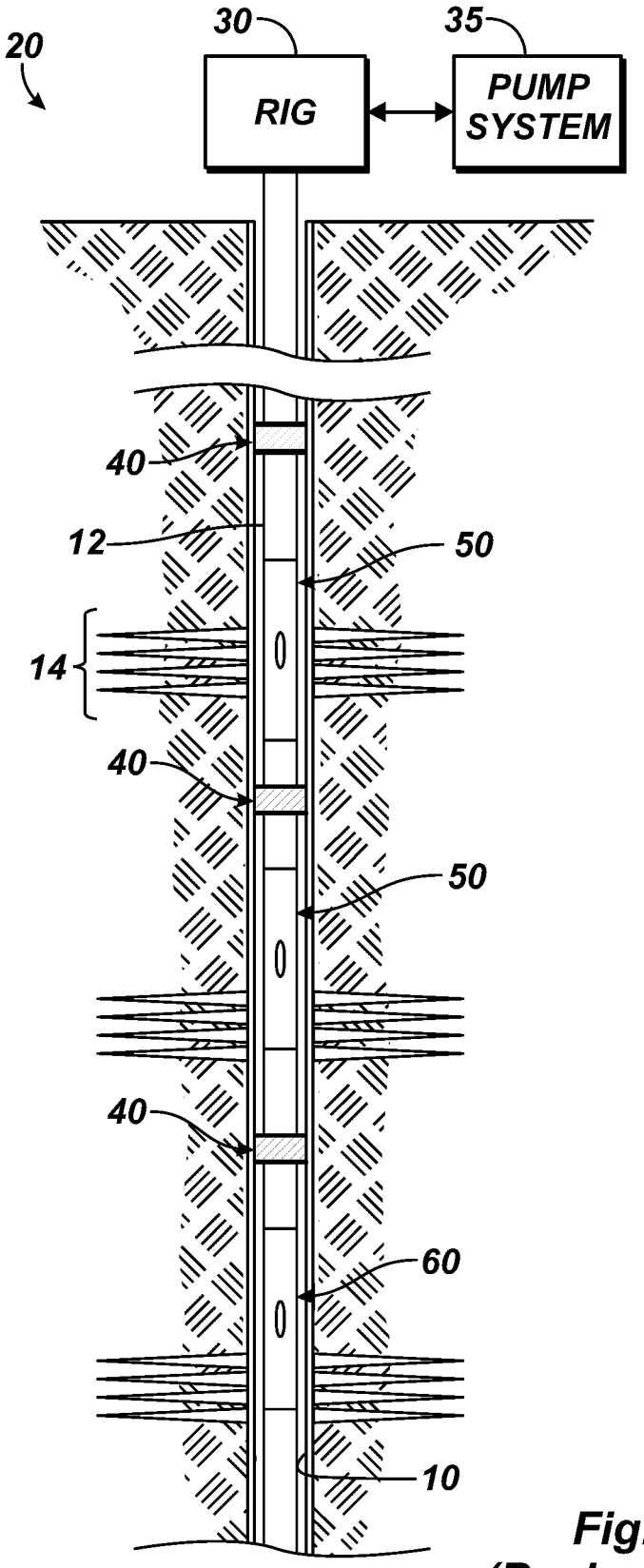
FIG. 1 illustrates a tubing string having sliding sleeves and a toe sleeve as background to the present disclosure.
Figures 2A, 2B, 2C:
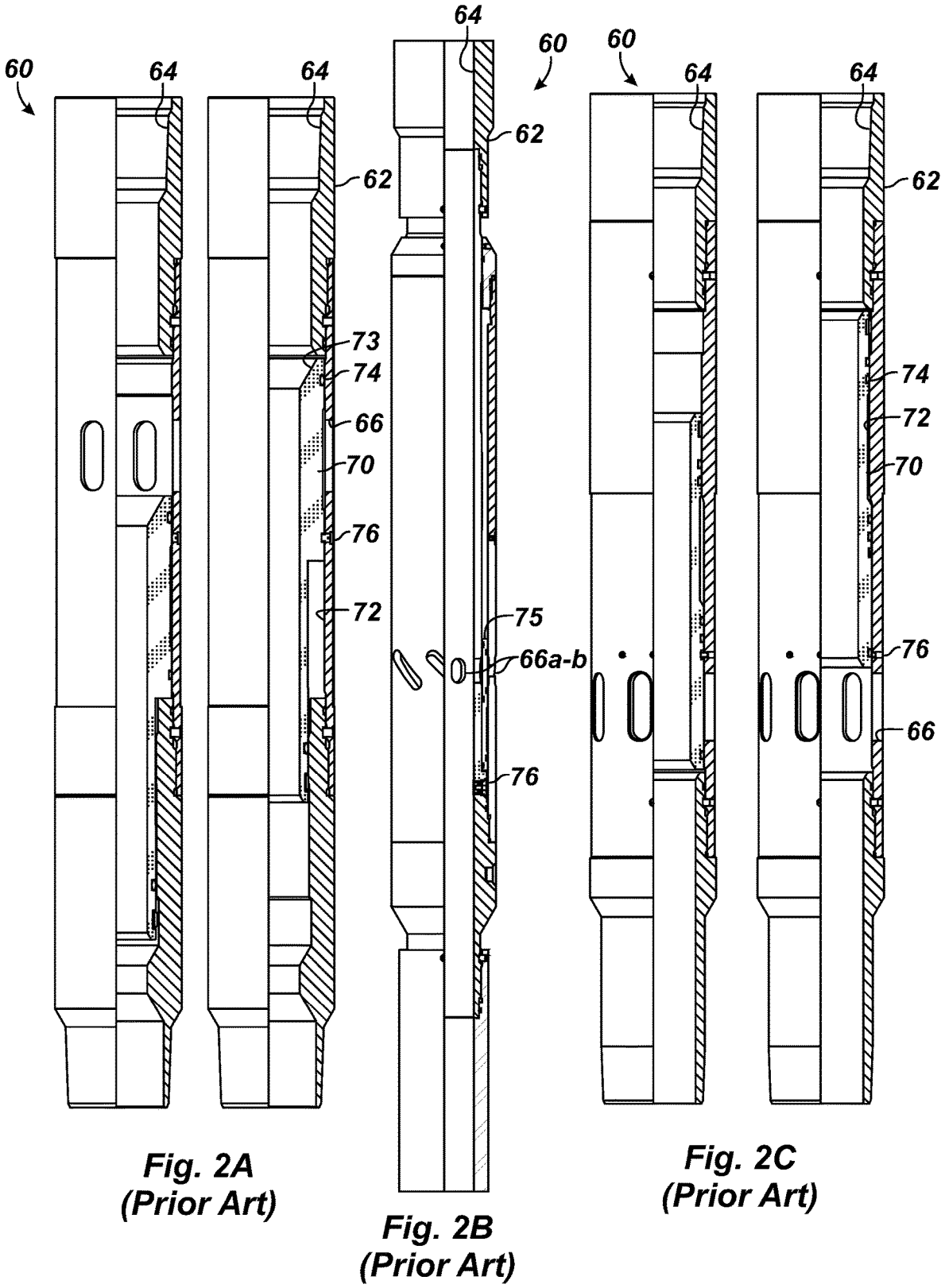
Fig. 2A (Prior Art)
Fig. 2B (Prior Art)
Fig. 2C (Prior Art)
FIGS. 2A-2E illustrate various toe sleeves according to the prior art in partial cross-section.
Figure 2D:
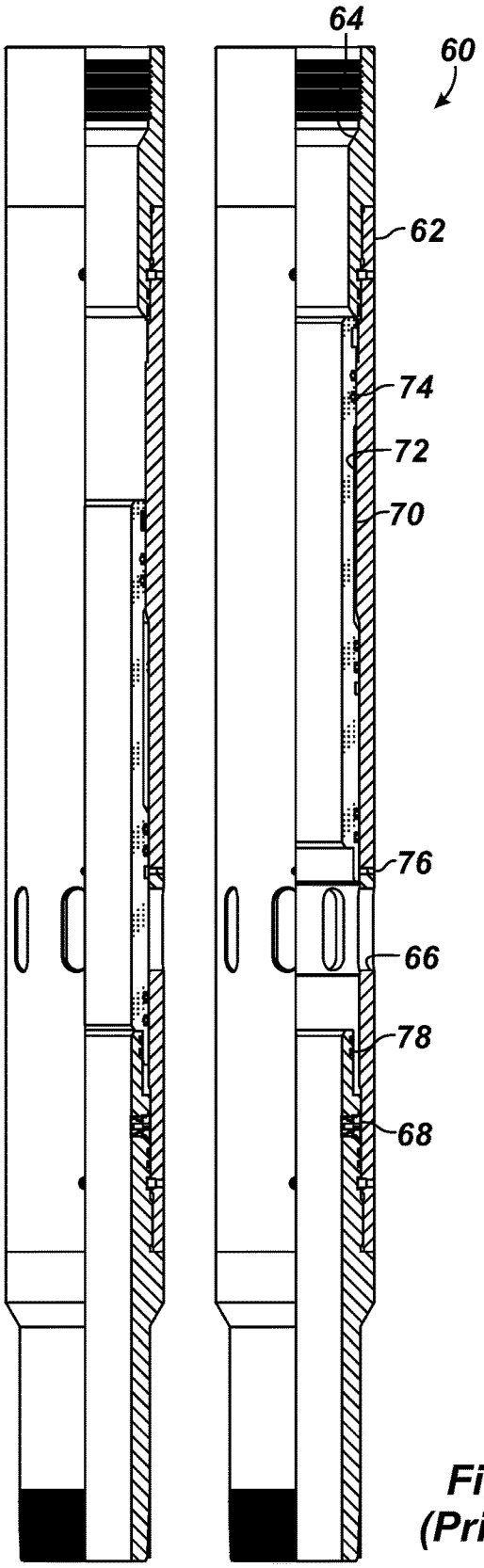
Fig. 2D (Prior Art)
Figure 2E:
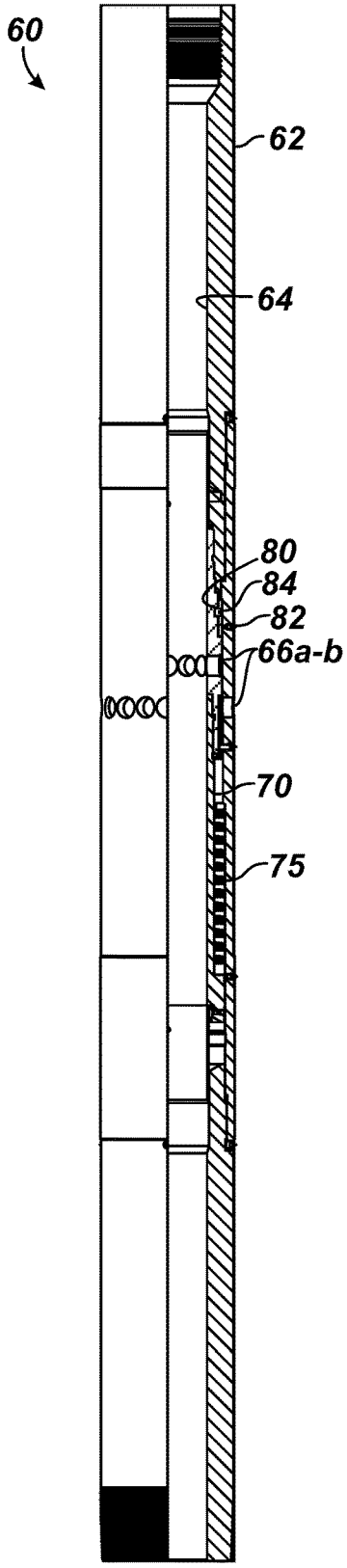
Fig. 2E (Prior Art)
Figure 3A:
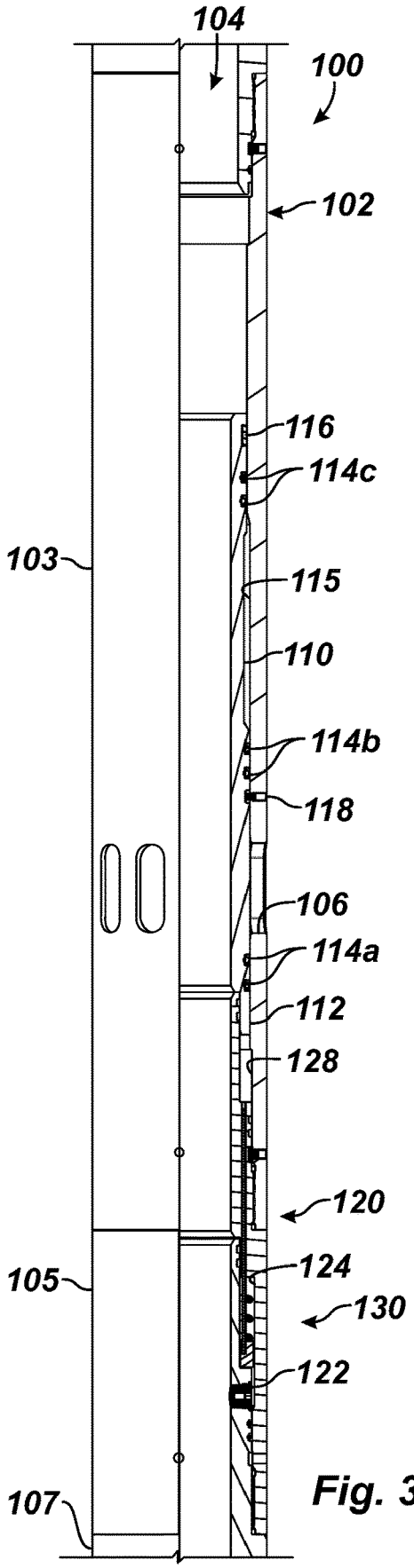
FIG. 3A illustrates a cross-sectional view of a toe sleeve according to the present disclosure in an indexing configuration.
Figures 4A, 4B, 4C:
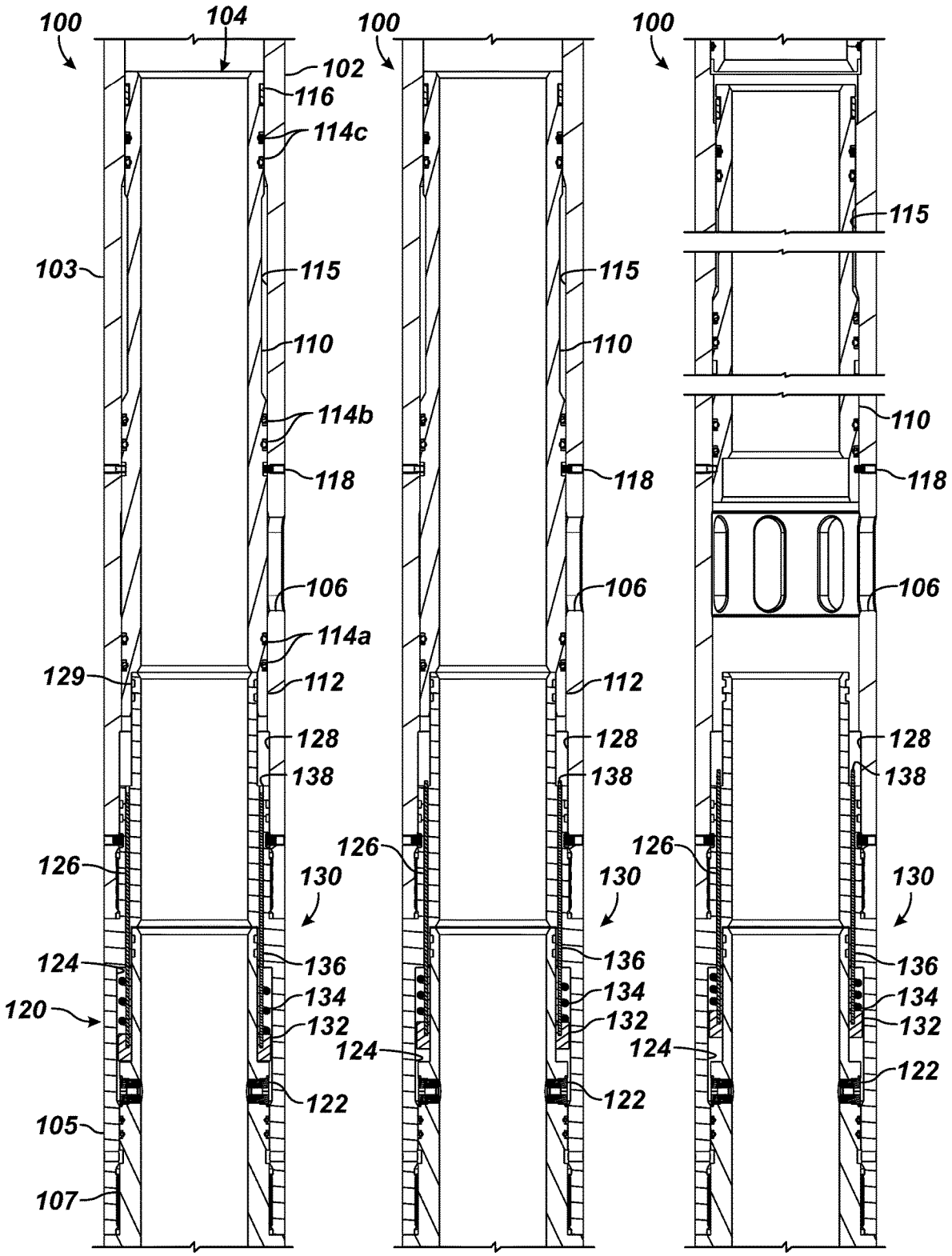
FIGS. 4A-4C illustrate the disclosed toe sleeve during stages of operation.

With a general understanding of how a toe sleeve is used, attention turns to details of a toe sleeve according to the present disclosure. In particular, FIG. 3A illustrates a cross-sectional view of a toe sleeve 100 according to the present disclosure, and FIGS. 4A-4C illustrate portions of the disclosed toe sleeve 100 during stages of operation. The toe sleeve 100 is actuatable in response to applied pressure down the tubing string in a completion system, such as discussed previously.

The toe sleeve 100 includes a housing 102 defining a housing bore 104 therethrough and defining at least one port 106 communicating the housing bore 104 outside the housing 102. Internally, the housing 102 has a communication path 120 extending from a first part or internal space 124 of the housing bore 104 to a second part or internal space 128 of the housing bore 104 via an intermediate passages 126—the arrangement of which will be described in more detail later.

An insert 110 is movably disposed in the housing bore 104 and has a distal end 112 sealably enclosing the second internal space 128 of the communication path 120. The insert 110 is movable from a first position (FIGS. 4A-4B) covering the at least one port 106 to a second position (FIG. 4C) uncovering the at least one port 106. The insert 110 has first and second seals 114*a-b* sealing against the housing bore 104 on both sides of the at least one port 106 when the insert 110 is in the first position (FIGS. 4A-4B).

The insert 110 also has second and third seals 114*b-c* that in the first position (FIGS. 4A-4B) define a sealed chamber 115 with the housing bore 104. The volume of this sealed chamber 115 can be at atmospheric pressure and can assist in the movement of the insert 110 from the first position to the second position (FIG. 4C) during operation. Finally, the insert 110 comprises a lock 116 engageable with the housing bore 104 when the insert 110 is in the second position (FIG. 4C) to lock the insert 110 open.

Movement of the insert 110 from the closed position (FIGS. 4A-4B) to the opened position (FIG. 4C) is controlled by pressure applied down the tubing string (not shown) to the housing bore 104. In fact, a counted number of applications of the applied pressure can eventually open the insert 110. In particular, an indexer 130 movably disposed in the communication path 120 moves in response to the applied pressure at the first internal space 124 of the communication path 120. As the applied pressure is communicated and released, the indexer 130 counts the number of times pressure is applied and eventually permits fluid communication of the applied pressure from the first internal space 124 to the second internal space 128 in response to the counted number. The applied fluid pressure in the second internal space 128 can then act against the distal end 112 of the insert 110 and can initiate the movement of the insert 110 from the first position (FIGS. 4A-4B) to the second position (FIG. 4C).

Particulars of the indexer 130 and communication path 120 are best shown in FIGS. 4A-4C. To initially control communication of the applied pressure to the indexer 130, a breachable barrier, such as an arrangement of rupture discs 122, can be disposed between the housing bore 102 and the first internal space 124 of the communication path 120. A specified level of pressure applied in the housing bore 104 can initially breach the rupture discs 122 so the applied pressure can act against the indexer 130 in the first internal space 124.

In one implementation, the indexer 130 is a piston having a first piston portion or cycling ring 132 and a second piston portion or rod(s) 136. Preferably, several rods 136 are used about the circumference of the housing 102. The cycling ring 132 is movably disposed in the first internal space 124, and the rods 136 are movably disposed relative to the second internal space 128. The cycling ring 132 moves in response to the applied pressure at the first internal space 124 and moves the piston rods 136 relative to sealed engagement with the communication path 120 at the second internal space 128.

As shown, the rods 136 can move in intermediate passages 126 interconnecting the first and second internal spaces 124 and 128 with one another. Portions 138 of these rods 136 are kept in sealed engagement with the intermediate passages 126. For example, seals (O-rings or the like) toward the distal ends 138 of the rods 136 can move inside the intermediate passages 126 and can move out of sealed engagement with the passages 126 if the rods 136 are moved axially far enough by the cycling ring 132.

As the rods 136 are moved, the rods 136 in a sealed condition (FIGS. 4A-4B) prevent communication of the applied pressure from the first internal space 124 to the second internal space 126 through the passages 128. However, the rods 136 moved axially in an unseal condition (FIG. 4C) permit the communication of the applied pressure from the first internal space 124 to the second internal space 128 through the passage 126. In turn, the applied pressure in the second space 128 can act on the distal end 112 of the insert 110 to assist in the shifting of the insert 110 open in the housing 102.

As shown, the insert's distal end 112 engages at least one seal 129 disposed in the second internal space 128 of the communication path 120. As the applied pressure communicated from the passages 126 builds in the second internal space 128, the pressure acts against the distal end 112 of the insert 110. At least one retainer or shear pin 118 can at least temporarily hold the insert 110 in the closed position (FIGS. 4A-4B) and is breakable or shearable in response to a level of the applied pressure against the insert's distal end 112 at the second internal space 128. Once the shear pin 108 breaks, the insert 110 shifts open (in an uphole direction) with the assistance of the atmospheric chamber 115 sealed by the insert's seals 114*b-c* with the housing 102 decreasing in volume.

Counting by the indexer 130 can be achieved in a number of ways. In one particular embodiment, a spring 134 disposed in the first internal space 124 biases the cycling ring 132 against the application of the applied pressure from the ruptured discs 122. The cycling ring 132 and the first internal space 124 can have a pin and slot arrangement alternatingly moving the ring 132 in the first internal space 124 in response to each of the applications of the applied pressure. Details of one type of pin and slot arrangement are revealed in the detailed views of FIGS. 5 and 6A-6C discussed later.

To facilitate assembly and enable modular construction, the housing 102 comprises upper, intermediate, and lower housing portions or subs 103, 105, 107 coupling together in series. The intermediate sub 105 couples to a lower end of the upper sub 103 and defines the second internal space 128 of the communication path 120 therewith. Components of the indexer 130 (e.g., ring 132, spring 134, rods 136, etc.) are assembled, and the lower sub 107 is coupled with a lower end of the intermediate 105 to enclose the first internal space 124 with the indexer 130 therein. The insert 110 is disposed primarily in the upper sub 103, and the insert's distal end 112 encloses the second internal space 128 of the communication path 120 defined by the intermediate sub 105 coupled with the upper sub 103.

Figure 3B:
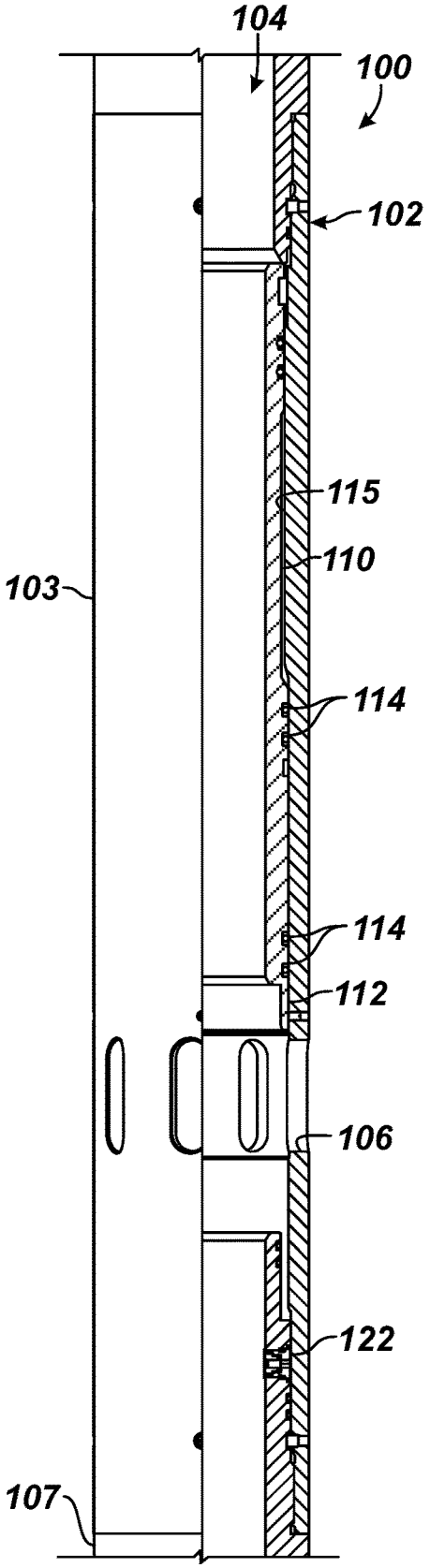
FIG. 3B illustrates a cross-sectional view of the disclosed toe sleeve in a non-indexing configuration.

If it is desired to configure the toe sleeve 100 for a conventional instantaneous-open form of operation, then the intermediate sub 105 can be omitted along with the components of the indexer 130. In this way, the lower sub 107 can couple directly to the lower end of the upper sub 103, as shown in FIG. 3B. The tool 100 configured in this way can operate in a manner similar to a rupture disc toe sleeve of the prior art, such as described in the background section of the present disclosure.

Figures 6A, 6B, 6C:
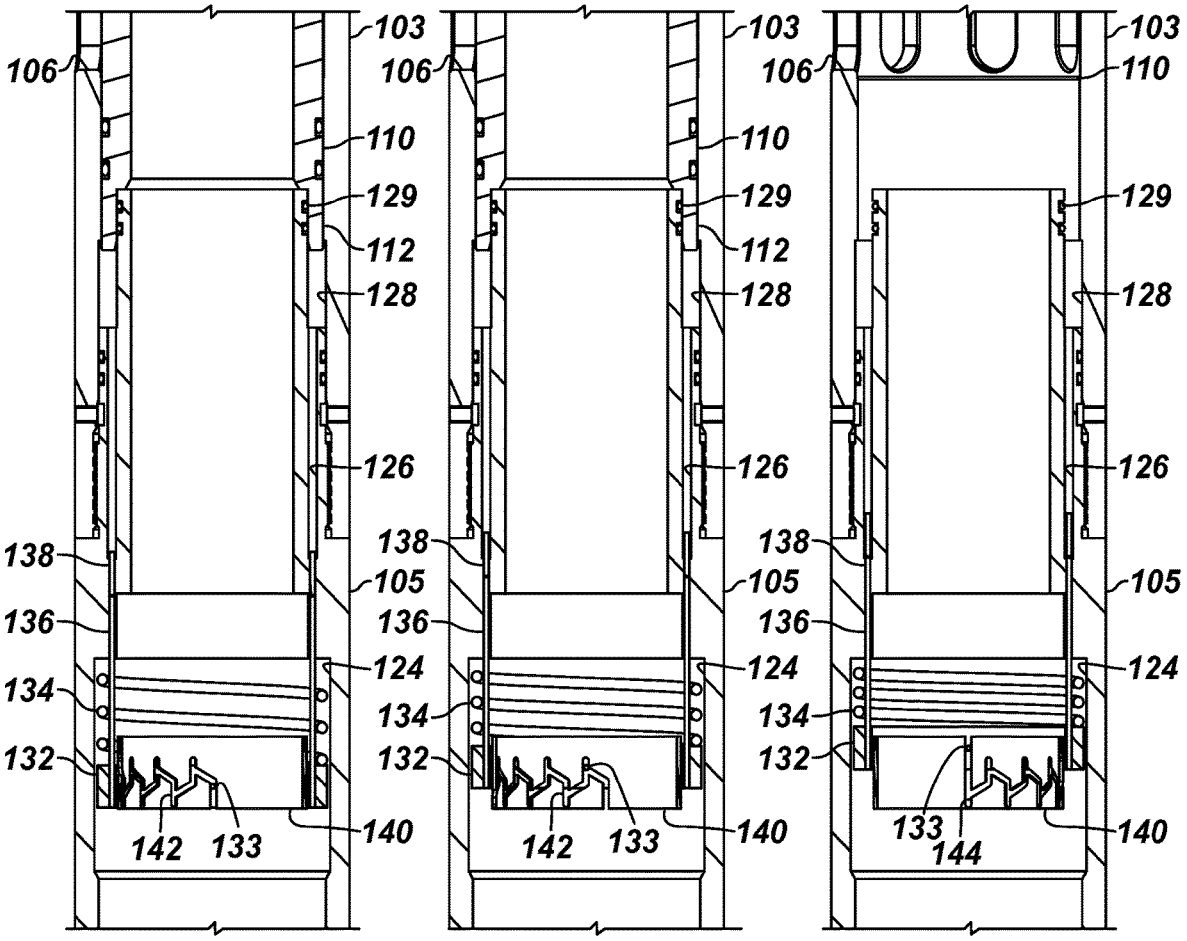
FIGS. 6A-6C illustrate the disclosed toe sleeve with the pin and slot indexing arrangement exposed during stages of operation.
Figure 5:
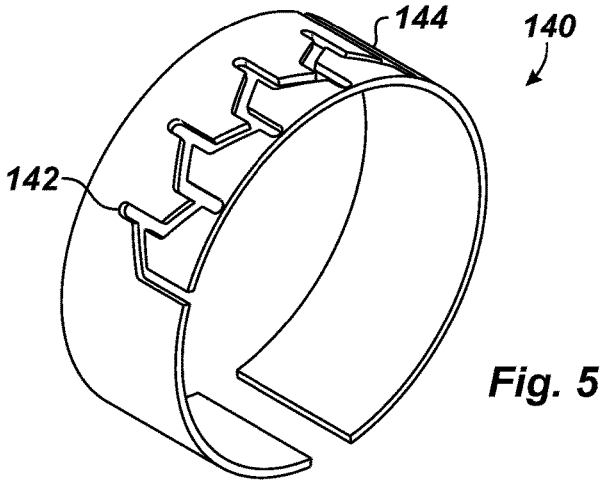
FIG. 5 illustrates a profiled sleeve for the pin and slot indexing arrangement of the disclosed toe sleeve.

As noted above, counting by the indexer 130 can be achieved using a pin and slot arrangement. FIGS. 5 and 6A-6C show details of one type of pin and slot arrangement for the disclosed toe sleeve 100. In particular, FIGS. 6A-6C illustrate portions of the upper sub 103 coupled to the intermediate sub 105. The lower sub (107) is not shown so details of a slotted sleeve 140 can be seen at different stages in time during operation. The slotted sleeve 140, which is shown on its own in FIG. 5, is disposed about the lower sub (107) and is exposed in the first internal space 124 formed by the intermediate sub 105 and the lower sub (107).

The cycling ring 132 has a pin 144 that can ride in a slot profile 142 of the slotted sleeve 140 as the cycling ring 132 is moved by the applied pressure in the first internal space 124 against the bias of the spring 134. As the pin 144 rides in the slot profile 142 of the slotted sleeve 140, axial movement of the cycling ring 132 is controlled between upper and lower limits of the profile 142. Meanwhile, the slotted sleeve 140 can rotate about the outside of the lower sub (107), allowing the ring's pin 144 to successively ride along the slot profile 142. Eventually, with the cycling from the application of pressure, the cycling ring 140 aligns the pin 144 with the final axial portion 146 of the slot profile 142, which allows the cycling ring 132 to move past the slotted sleeve 140 on the outside of the lower sub (107) with the last application of pressure on the ring 132.

When moved past the slotted sleeve 140 in this final application of pressure, the cycling ring 132 can then push the piston rods 136 further through the passages 126 so that the seals on the rods' ends 138 become unsealed. Flow of pressure can then communicate from the lower space 124 to the upper space 128 through the now unsealed passages 126 so that the insert 110 can be sheared free and shifted open.

In this arrangement, the piston rods 136 can be affixed to the cycling ring 132, which simply moves axially (up and down) in the first internal space 124 on the outside of the lower sub (107), as pressure is applied and released. The slotted sleeve 140, which is positioned around the outside of the lower sub (107), is allowed to rotate as the ring's pin 144 rides in the slot profile 142 of the slotted sleeve 140 until the pin 144 eventually reaches the final axial portion 146 of the profile 142.

Other pin and slot arrangements can be used. For example, the lower sub (107) may have a J-slot profile defined on it that is exposed to the first internal space 124. The cycling ring 132 can have a pin 144 that rides in the sub's J-slot profile, and the ring 132 can be allowed to move both axially and radially during the cycling. For their part, the ends of the rods 136 in this configuration can be caught on the ring 132 but may allow the ring 132 to rotate while the rods 136 can be held to move only axially in the passages 126.

As can be seen above, the toe sleeve 100 has a rupture disc 122 and has an intermediate sub 105, modularizing the sleeve's housing 102 and containing everything required to convert from instant-open operation (FIG. 3B) to pressure-insensitive operation (FIG. 3A). Since the indexer 130 can count the applications of pressure, use of the rupture disc 122 may not always be necessary, but is generally beneficial.

In summary, the modular intermediate sub 105, cycling ring 132, spring 134, piston rods 136, etc. can convert a conventional type of toe sleeve (FIG. 3B) into the pressure-insensitive toe sleeve 100 (FIG. 3A) of the present disclosure. Within the intermediate sub 105, the cycling ring 132 is retained by the J-slot profile 142 of the slotted sleeve 140, and the cycling ring 132 actuates the piston rods 136 that extend through the passages 126 of the intermediate sub 105 into the space 128 created at the connection to the lower sub 107. Once pressure is applied to activate the sleeve 100, the pressure acts on the cycling ring 132 and the piston rods 136, compressing the spring 134 in the intermediate sub 105 and allowing for an indefinite tubing pressure test to be held. Once pressure is relieved, the spring 134 cycles the ring 132 back to its initial position.

The J-slot profile 142 of the slotted sleeve 144 can have as many cycles as required, and on the final cycle, the piston rods 136 come off seat, allowing applied pressure to act on the insert's seals 114*a-c* and 129, opening the insert 110 in the housing 102 as the sealed chamber 115 decreases in volume.

The toe sleeve 100 allows for high pressure tubing tests and can be held indefinitely during the test. Capable of being held during tests, the toe sleeve 100 can meet various different casing testing regulations. The toe sleeve 100 can be further configured to require a certain number of pressure cycles to function the sleeve 100 open. This allows the toe sleeve 100 to operate more appropriately to imperfect downhole conditions, such as when errors occur during pressure tests due to pumps failing, pressure being lost etc. without compromising the integrity of the final tubing pressure test.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool actuatable in response to applied pressure, the tool comprising:

a housing defining a housing bore therethrough and defining at least one port communicating the housing bore outside the housing, the housing having a communication path extending from a first part of the housing bore to a second part of the housing bore;

an indexer disposed in the communication path, the indexer comprising:

a piston movably responsive to the applied pressure at the first part of the communication path, a counter engaged between the piston and the housing and counting a plurality of applications of the applied pressure at the first part of the communication path against the piston, and a seal engagement connected to the piston and movable therewith, the seal engagement having a first condition initially sealing fluid communication of the applied fluid pressure from the first part to the second part, the seal engagement having a second condition subsequently permitting the fluid communication of the applied pressure from the first part to the second part in response to the counted applications; and an insert movably disposed in the housing bore, the insert being movable from a first position covering the at least one port to a second position uncovering the at least one port, at least a portion of the insert acted upon by the applied pressure in the second part and initiating movement of the insert from the first position to the second position.

2. The tool of claim 1, wherein the piston comprises a ring movably disposed in a first internal space of the first part.

3. The tool of claim 2, wherein the seal engagement comprises at least one rod connected to the ring and movable therewith in at least one intermediate passage between the first and second parts of the communication path, the at least one rod in the first condition preventing the fluid communication of the applied pressure through the at least one intermediate passage from the first internal space to the second part of the communication path, the at least one rod in the second condition permitting the fluid communication of the applied pressure through the at least one intermediate passage from the first internal space to the second part.

4. The tool of claim 2, wherein the indexer comprises a spring disposed in the first internal space and biasing the ring against the application of the applied pressure.

5. The tool of claim 2, wherein the counter of the indexer comprises a pin and slot arrangement configured to alternatingly move the ring in the first internal space in response to each of the applications of the applied pressure.

6. The tool of claim 5, wherein the pin and slot arrangement comprises:

a sleeve defining a slot profile and rotatably disposed in the first internal space; and a pin disposed on the ring and movable in the slot profile.

7. The tool of claim 1, wherein the insert comprises at least one of:

at least one retainer at least temporarily holding the insert in the first position and being breakable in response to a level of the applied pressure acting against the portion of the insert;

a lock engageable with the housing bore when the insert is in the second position; and first and second seals sealing against the housing bore on both sides of the at least one port when the insert is in the first position.

8. The tool of claim 1, wherein the housing comprises a barrier disposed between the housing bore and the first part of the communication path and being breachable in response to a level of the applied pressure in the housing bore.

9. The tool of claim 1, wherein the second part of the communication path is exposed to the housing bore, and wherein the insert in the first position sealably encloses the second part of the communication path.

10. The tool of claim 1, wherein the housing comprises at least one of:

at least one seal disposed in the second part of the communication path and engaging the portion of the insert; and a sealed chamber defined between the housing bore and the insert and decreasing in volume with movement of the insert from the first position to the second position.

11. The tool of claim 1, wherein the housing comprises first, second, and third housing portions coupling together in series, the second housing portion coupling with an end of the first housing portion and defining the second part of the communication path, the third housing portion coupling with an end of the second housing portion and enclosing the first part of the communication path.

12. The tool of claim 11, wherein the insert is disposed in the first housing portion, and wherein the portion of the insert in the first position at least partially encloses the second part of the communication path defined by the second housing portion coupled with the end of the first housing portion.

13. The tool of claim 12, wherein the first and third housing portions couple together without the second housing portion and the indexer.

14. A downhole tool actuatable in response to applied pressure, the tool comprising:

a housing defining a housing bore therethrough and defining at least one port communicating the housing bore outside the housing, the housing having a communication path communicating the housing bore with a first internal space and communicating the first internal space with a second internal space;

a piston movably disposed in the first internal space and movably responsive to the applied pressure at the first internal space of the communication path;

a counter engaged between the piston and the housing;

a seal engagement connected to the piston and having a first condition initially sealing fluid communication of the applied fluid pressure from the first internal space to the second internal space; and an insert movably disposed in the housing bore and sealably enclosing the second internal space of the housing, the insert being movable from a first position covering the at least one port to a second position uncovering the at least one port, the piston movably responsive to the applied pressure from the communication path and moving the seal engagement with respect to the second internal space, the counter counting a plurality of applications of the applied pressure against the piston, the seal engagement moved by the piston to a second condition permitting the fluid communication of the applied pressure from the first internal space to the second internal space in response to the counted applications, at least a portion of the insert acted upon by the applied pressure in the second internal space initiating movement of the insert from the first position to the second position.

15. A kit for converting a downhole tool actuatable in response to applied pressure, the downhole tool having a housing with a first housing portion coupleable to a second housing portion, the housing defining a housing bore therethrough and defining at least one port communicating the housing bore outside the housing, the downhole tool having an insert movably disposed in the housing bore, the insert being movable from a first position covering the at least one port to a second position uncovering the at least one port, the kit comprising:

a modular housing portion coupleable between the first and second housing portions, the modular housing portion configurable to enclose a first internal space with the first housing portion and to at least partially enclose a second internal space with the second housing portion, the modular housing portion having a communication path extending from the first internal space to the second internal space; and an indexer positionable in the communication path, the indexer comprising:

a piston movably responsive to the applied pressure at the first internal space, a counter engaged between the piston and the modular housing portion and configurable to count a plurality of applications of the applied pressure at the first internal space against the piston, and a seal engagement connected to the piston and movable therewith, the seal engagement having a first condition configured to seal fluid communication of the applied pressure from the first internal space to the second internal space, the seal engagement having a second condition configured to permit, in response to the counted applications, the fluid communication of the applied pressure from the first internal space to the second internal space for initiating movement of the insert from the first position to the second position.

16. The kit of claim 15, wherein the piston comprises a ring movably positionable in the first internal space.

17. The kit of claim 16, wherein the seal engagement comprises at least one rod connected to the ring and movable therewith in at least one intermediate passage between the first and second internal spaces of the communication path, the at least one rod configurable in the first condition to prevent the fluid communication of the applied pressure through the at least one intermediate passage from the first internal space to the second internal space and configurable in the second condition to permit the fluid communication of the applied pressure through the at least one intermediate passage from the first internal space to the second internal space.

18. The kit of claim 16, comprising a spring positionable in the first internal space and configured to bias the ring against the application of the applied pressure.

19. The kit of claim 16, wherein the counter comprises a pin and slot arrangement configured to alternatingly move the ring in the first internal space in response to each of the applications of the applied pressure.

20. The kit of claim 19, wherein the pin and slot arrangement comprises:

a sleeve defining a slot profile and rotatably positionable in the first internal space; and a pin disposed on the ring and movable in the slot profile.

* * * * *